US009475563B2

(12) United States Patent
Shomura et al.

(10) Patent No.: US 9,475,563 B2
(45) Date of Patent: Oct. 25, 2016

(54) ELECTRIC OUTBOARD MOTOR

(71) Applicant: SUZUKI MOTOR CORPORATION, Hamamatsu-shi, Shizuoka (JP)

(72) Inventors: Nobuyuki Shomura, Hamamatsu (JP); Akinori Yamazaki, Hamamatsu (JP); Sho Ishizaki, Hamamatsu (JP)

(73) Assignee: SUZUKI MOTOR CORPORATION, Hamamatsu-Shi (JP)

( * ) Notice: Subject to any disclaimer, the term of this patent is extended or adjusted under 35 U.S.C. 154(b) by 0 days.

(21) Appl. No.: 14/817,913

(22) Filed: Aug. 4, 2015

(65) Prior Publication Data

US 2016/0039510 A1 Feb. 11, 2016

(30) Foreign Application Priority Data

Aug. 11, 2014 (JP) ..... 2014-163305

(51) Int. Cl.

| | |
|---|---|
| ***B63H 21/17*** | (2006.01) |
| ***B63H 20/14*** | (2006.01) |
| *B63H 20/08* | (2006.01) |
| *B63H 20/32* | (2006.01) |

(52) U.S. Cl.

CPC ..... *B63H 21/17* (2013.01); *B63H 20/14* (2013.01); *B63H 20/08* (2013.01); *B63H 20/32* (2013.01)

(58) Field of Classification Search

CPC ..... B63H 21/17; B63H 20/14

See application file for complete search history.

(56) References Cited

U.S. PATENT DOCUMENTS

| | | | | |
|---|---|---|---|---|
| 2,676,559 | A * | 4/1954 | Davies | B63H 20/10 123/195 P |
| 3,368,420 | A * | 2/1968 | Alexander, Jr. | B63H 20/10 440/75 |
| 2008/0233814 | A1* | 9/2008 | Reuter | B63H 20/00 440/75 |

FOREIGN PATENT DOCUMENTS

JP 2005-162055 A 6/2005

* cited by examiner

*Primary Examiner* — Stephen Avila
(74) *Attorney, Agent, or Firm* — Stein IP, LLC

(57) ABSTRACT

There is provided an electric outboard motor. An upper unit is provided to be rotatable in a horizontal direction about a swivel unit. A lower unit is provided below the upper unit and configured to function as a rudder. The upper unit comprises an electric motor supported by a rear side of the swivel unit via a mount unit. The upper unit or lower unit has a gear deceleration device configured to couple an output shaft of the electric motor and a drive shaft extending in an upward and downward direction to each other. The drive shaft is coupled to the gear deceleration device in front of the output shaft of the electric motor and configured to transmit an output of the electric motor to a propeller provided in the lower unit.

6 Claims, 3 Drawing Sheets

ELECTRIC OUTBOARD MOTOR

CROSS-REFERENCE TO RELATED APPLICATIONS

The disclosure of Japanese Patent Application No. 2014-163305 filed on Aug. 11, 2014, including specification, drawings and claims is incorporated herein by reference in its entirety.

TECHNICAL FIELD

The invention relates to an electric outboard motor.

BACKGROUND

In the related art, an electric outboard motor using an electric motor as a power source has been known.

For example, as shown in FIG. 3, an electric outboard motor 100 having an upper unit 101, a middle unit 102 and a lower unit 103 and configured to be dividable into three pieces is disclosed (refer to Patent Document 1). The middle unit 102 has a lower mount 112 provided at a lower part of a middle case 110, an upper mount 113 provided in a mount case 111 positioned at an upper part of the middle case 110, an electric motor 114 covered by a motor cover 115, and a bracket device 116 attached to a hull 200. The bracket device 116 has a swivel unit 117 (steering shaft) configured to rotatably support front end portions of the respective mounts 112, 113 and a tilt shaft 118 arranged in front of an upper end of the swivel unit 117. The lower unit 103 has a lower case 120 functioning as a rudder, and a propeller shaft 122 configured to transmit an output of the electric motor 114 to a propeller 123 via a drive shaft 121.

The middle unit 102 is provided with a gear deceleration device 130 configured by a drive gear 131 and a driven gear 132. The driven gear 132 is arranged in front of the drive gear 131. An output shaft of the electric motor 114 is coupled to the drive gear 131, and an upper end portion of the drive shaft 121 is coupled to the driven gear 132. In the meantime, the drive shaft 121 extends downwards to couple a lower end portion thereof to the propeller shaft 122.

The lower mount 112 is arranged below the driven gear 132 and the swivel unit 117 is arranged at the front of the driven gear 132. That is, the gear deceleration device 130, the electric motor 114 and the drive shaft 121 are offset rearwards with respect to the swivel unit 117 so as to avoid interference with the swivel unit 117. The electric outboard motor 100 (swivel unit 117) is configured to rotate (tilt up/down) in an upward and downward direction about the tilt shaft 118 serving as a support point.

Patent Document 1: Japanese Patent Application Publication No. 2005-162055A

However, the technology disclosed in Patent Document 1 has a problem that the middle unit 102 is enlarged because the electric motor 114, the drive shaft 121 and the like are offset rearwards so as to avoid the swivel unit 117. Also, the technology disclosed in Patent Document 1 has a problem that the number of components and a weight increase because the useless components such as the motor cover 115 and the mount case 111 are provided.

Also, according to the technology of Patent Document 1, since the lower case 120 functioning as a rudder is offset rearwards with respect to the swivel unit 117, it is difficult to shorten an interval D1 (offset amount) between a center C of a lateral rudder force (lift force of the rudder) acting on the lower case 120 and a shaft center of the swivel unit 117.

For this reason, the technology of Patent Document 1 has a problem that a large force is required to operate the rudder. Further, the technology of Patent Document 1 has a problem that a large force is required to tilt up the electric outboard motor 100 because an interval D2 between a shaft center of the electric motor 114, which is a heavy object, and the shaft center of the swivel unit 117 increases.

SUMMARY

It is an object of the present invention to provide an electric outboard motor capable of reducing a size, a weight and a steering load and enabling a tilt operation to be easily performed.

According to an aspect of the embodiments of the present invention, there is provided an electric outboard motor comprising: an upper unit provided to be rotatable in a horizontal direction about a swivel unit; and a lower unit provided below the upper unit and configured to function as a rudder, wherein the upper unit comprises an electric motor supported by a rear side of the swivel unit via a mount unit, wherein the upper unit or lower unit has a gear deceleration device configured to couple an output shaft of the electric motor and a drive shaft extending in an upward and downward direction to each other, wherein the drive shaft is coupled to the gear deceleration device in front of the output shaft of the electric motor and configured to transmit an output of the electric motor to a propeller provided in the lower unit, and wherein the gear deceleration device is arranged below the swivel unit so as to overlap with the swivel unit in a front and rear direction.

With the above configuration, since the gear deceleration device is arranged below the swivel unit so as to overlap with the swivel unit, as seen from above, the gear deceleration device does not interfere with the swivel unit. Therefore, as compared to a configuration where the gear deceleration device is arranged at the rear of the swivel unit, the gear deceleration device, the electric motor and the drive shaft are provided at positions close to the swivel unit. For this reason, it is possible to make the upper unit small. Since the lower unit is also provided at a position close to the swivel unit, it is possible to reduce an interval (offset amount) between a center of a lateral lifting force acting on the lower unit serving as a rudder and the swivel unit. Thereby, the steering load is reduced to improve the operability of a hull operator. Further, it is possible to bring the electric motor, which is a heavy object, close to the swivel unit. Therefore, the hull operator can easily perform a tilt operation (tilt up or tilt down operation) of the electric outboard motor.

The gear deceleration device may be provided in the upper unit, and the lower unit may be detachably provided with respect to the upper unit.

With the above configuration, by separating the lower unit from the upper unit, an operator can efficiently check, maintain, repair and replace the respective components. In particular, it is possible to easily perform the maintenance (for example, the maintenance of the vicinity of the propeller) where it is not required to detach the gear deceleration device.

The gear deceleration device may be provided in the upper unit and comprise a gear case having a plurality of gears provided therein, the gear case may have an upper gear case provided at an upper side and a lower gear case provided at a lower side, and the upper gear case may be integrally formed with a motor housing having a rotor and a stator of the electric motor provided therein.

With the above configuration, since the upper gear case of the gear case is integrally formed with the motor housing, it is possible to reduce the number of components. Also, since the upper gear case and the motor housing are integrally formed and are thus reinforced each other, it is possible to improve the durability.

The mount unit may be integrally formed with a motor housing having a rotor and a stator of the electric motor provided therein.

With the above configuration, it is possible to omit the motor cover provided to cover the electric motor so as to improve the stiffness in the related art. Thereby, it is possible to reduce the number of components and to save the weight. Also, since the mount unit and the motor housing are integrally formed and are thus reinforced each other, it is possible to improve the stiffness.

According to the present invention, it is possible to reduce the size, the weight and the steering load and to easily perform the tilt operation.

BRIEF DESCRIPTION OF THE DRAWINGS

In the accompanying drawings:

FIGS. 2A and 2B illustrate the electric outboard motor of the illustrative embodiment of the present invention, in which FIG. 2A is a partial sectional view illustrating an electric motor and an upper mount unit, and FIG. 2B is a partial sectional view illustrating the electric motor, a lower mount unit and the like.

DETAILED DESCRIPTION OF THE EMBODIMENTS

Hereinafter, a preferred illustrative embodiment of the present invention will be described with reference to the accompanying drawings.

Figure 1:
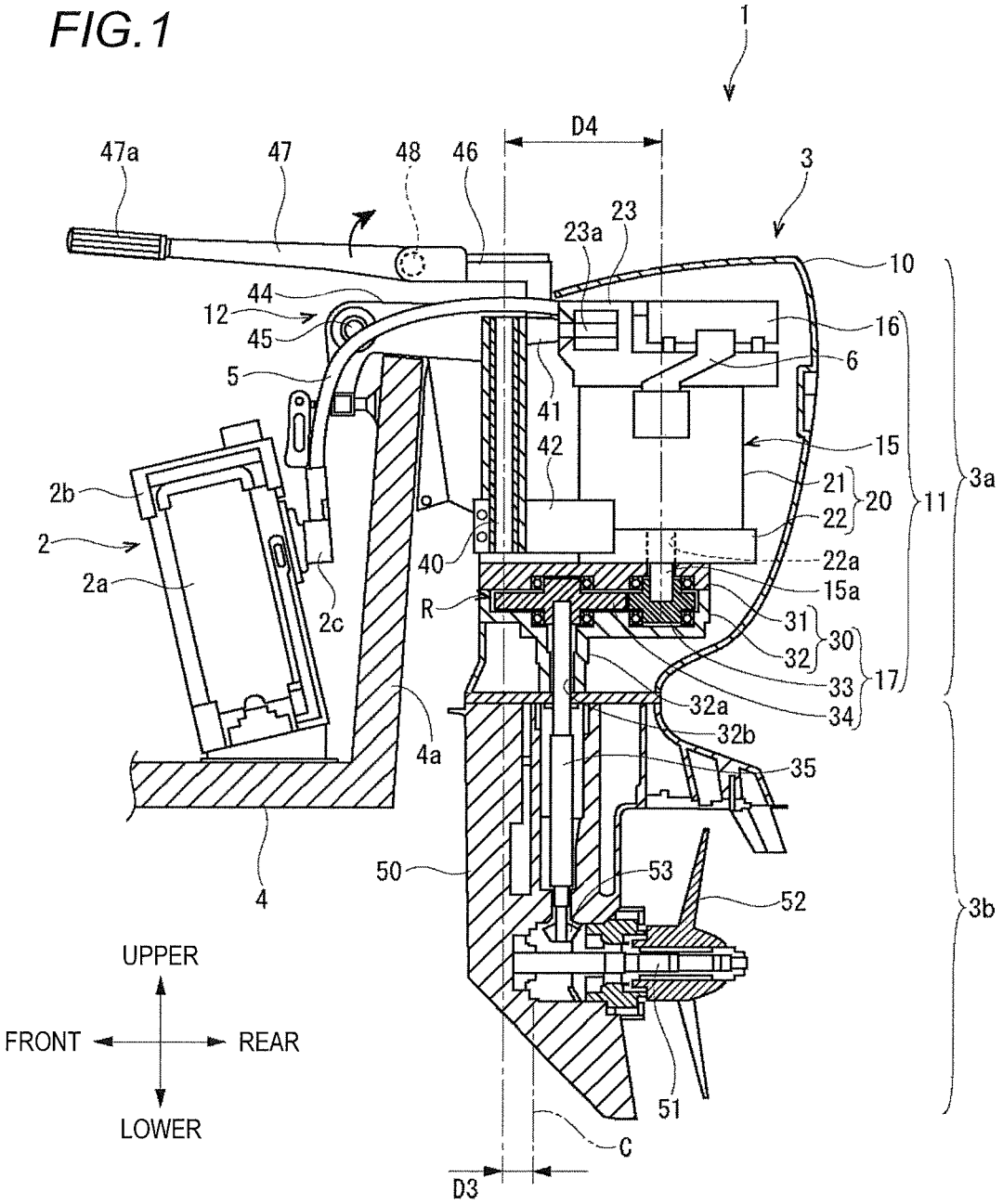
FIG. 1 is a longitudinal sectional view illustrating an electric outboard motor according to an illustrative embodiment of the present invention.
Figure 2A:
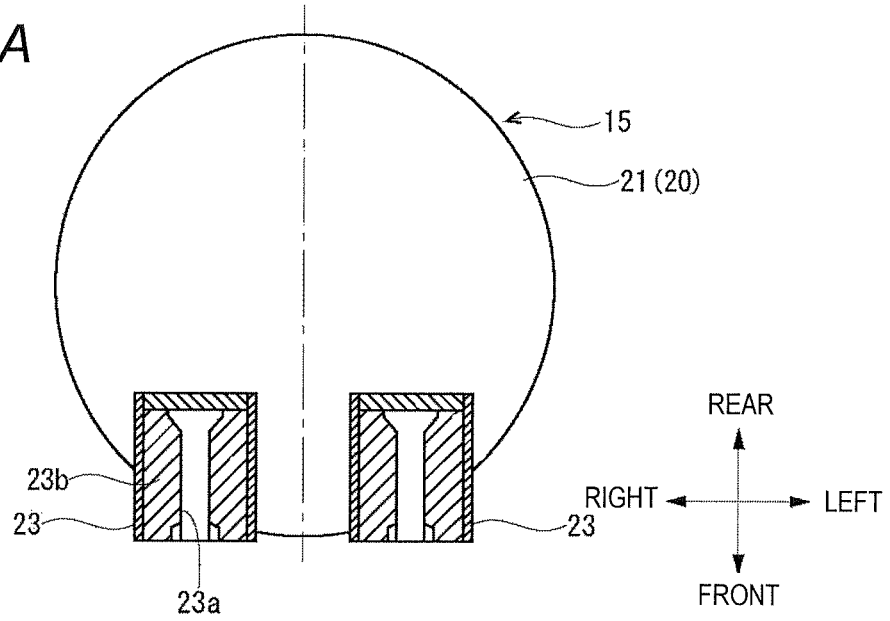
Figure 2B:
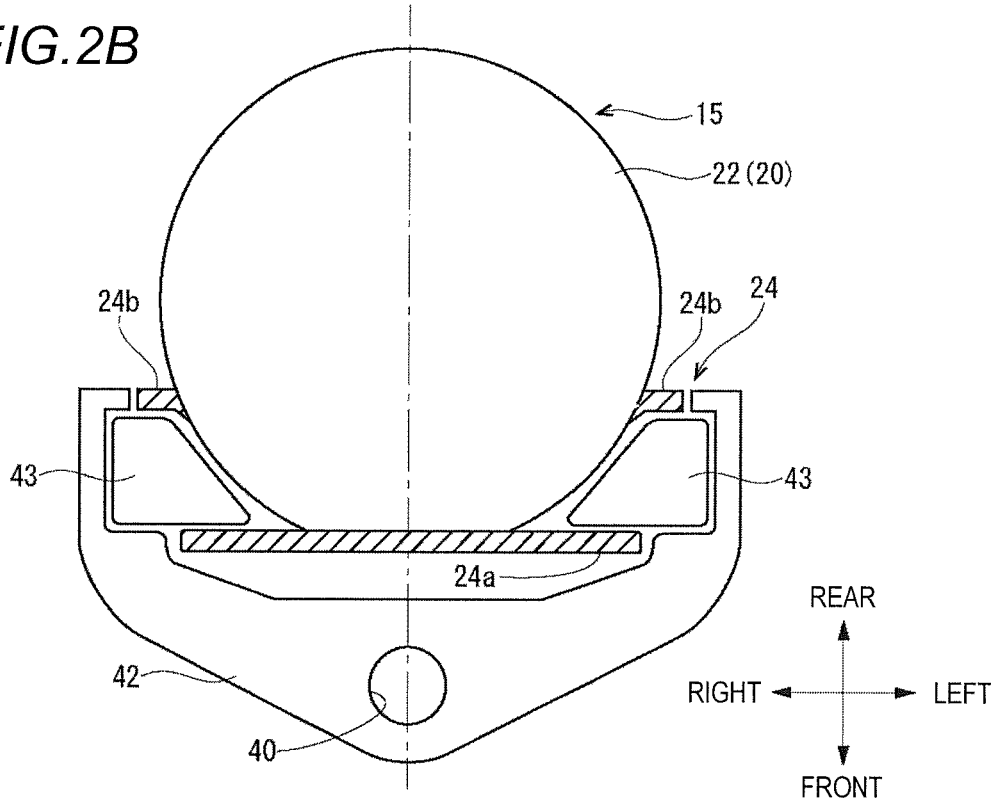

An electric outboard motor 3 of the illustrative embodiment is described with reference to FIGS. 1, 2A and 2B. FIG. 1 is a longitudinal sectional view illustrating the electric outboard motor 3. FIG. 2A is a partial sectional view illustrating an electric motor 15 and an upper mount unit 23. FIG. 2B is a partial sectional view illustrating the electric motor 15, a lower mount unit 24 and the like. Meanwhile, in below descriptions, an advancing direction of a hull 4 having the electric outboard motor 3 attached thereto is referred to a front and the directions are appropriately shown in the respective drawings.

As shown in FIG. 1, an outboard motor system 1 has a power supply unit 2 and the electric outboard motor 3. The power supply unit 2 is configured separately from the electric outboard motor 3 and is arranged inside the hull 4. The electric outboard motor 3 is attached to a transom 4*a* of the hull 4.

The power supply unit 2 has a battery pack 2*a* and a battery housing case 2*b*. For example, an assembly of lithium ion battery cells is housed in an external case, so that the battery pack 2*a* is configured. The battery pack 2*a* is detachably provided in the battery housing case 2*b*. The battery pack 2*a* detached from the battery housing case 2*b* is charged by a charger (not shown) and is thus repeatedly used. The battery housing case 2*b* is provided with a coupler 2*c* for connecting one end portion of a power supply cable 5 thereto. In the meantime, the power supply unit 2 may have a charging function.

The electric outboard motor 3 has an upper unit 3*a* provided at an upper side and a lower unit 3*b* provided at a lower side, and is configured to be dividable in an upward and downward direction.

The upper unit 3*a* includes an upper unit case 10, a motor unit 11 and a bracket device 12.

The upper unit case 10 is integrally formed of a synthetic resin, for example, and configures a main outward appearance of the upper unit 3*a*. In the upper unit case 10, the motor unit 11 is arranged.

The motor unit 11 includes an electric motor 15, a control device 16 and a gear deceleration device 17. Also, the motor unit 11 has a water jacket (not shown) configured to enable cooling water for cooling the electric motor 15 to pass therethrough. In the meantime, the cooling method of the electric motor 15 is not limited to the water cooling method, and an air cooling method may also be adopted.

The electric motor 15 is configured by a rotor and a stator (all of which are not shown) provided in a motor housing 20. The motor housing 20 is formed by casting metal such as iron, aluminum and the like. The motor housing 20 has an upper housing 21 positioned at an upper side and a lower housing 22 positioned at a lower side and is configured to be dividable in the upward and downward direction.

The upper housing 21 has a substantially cylindrical shape of which an upper surface is closed and a lower surface is opened. The lower housing 22 has a substantial disc shape for closing the lower surface of the upper housing 21. The rotor and stator are arranged between the upper housing 21 and the lower housing 22 with an output shaft 15*a* extending from the rotor facing downwards vertically. The output shaft 15*a* protrudes downwards through a shaft hole 22*a* formed at the lower housing 22. In the meantime, the upper housing 21 is fixed to the lower housing 22 by a plurality of bolts (not shown), for example.

As shown in FIGS. 1 and 2A, an upper surface of the upper housing 21 is integrally formed with a pair of right and left upper mount units 23 serving as a mount unit. Each upper mount unit 23 is arranged to slightly protrude forwards from a front circumferential surface of the upper housing 21. Each upper mount unit 23 has a substantially cuboid shape, and is formed with a bolt hole 23*a* extending rearwards from the front surface. In the meantime, a rubber bush 23*b* is fitted around each bolt hole 23*a*.

As shown in FIG. 2B, the lower housing 22 is formed integrally with the lower mount unit 24 serving as a mount unit. The lower mount unit 24 has a front-side flange part 24*a* and a pair of right and left rear-side flange parts 24*b*. The front-side flange part 24*a* has a substantially plate shape extending in a right and left direction so that it is flush with of the front circumferential surface of the lower housing 22. The pair of right and left rear-side flange parts 24*b* protrudes in the right and left direction from the circumferential surface of the lower housing 22 at positions spaced rearwards from the front-side flange part 24*a*, respectively.

As shown in FIG. 1, the control device 16 is arranged at the rear of each upper mount unit 23 and on the upper surface of the upper housing 21. The other end portion of the power supply cable 5 is connected to the control device 16. The control device 16 is connected to the power supply unit 2 via the power supply cable 5 and is fed with power from the power supply unit 2. Also, the control device 16 is connected to the electric motor 15 via the power supply cable 5 and is configured to control driving of the electric motor 15.

The gear deceleration device 17 is configured to decelerate and output rotation of the electric motor 15. The gear deceleration device 17 includes a gear case 30, a drive gear 33 and a driven gear 34.

The gear case 30 is formed by casting metal such as iron, aluminum and the like. The gear case 30 has an upper gear case 31 positioned at an upper side and a lower gear case 32 positioned at a lower side.

The upper gear case 31 is formed integrally with the lower housing 22 of the motor housing 20. The upper gear case 31 is arranged on a lower surface of the lower housing 22 and has a substantial tray shape of which a lower side is opened. The upper gear case 31 extends more forwards than the lower housing 22. The lower gear case 32 closes the lower surface of the upper gear case 31 to configure a gear chamber R for arranging therein gears 33, 34. The lower gear case 32 is formed at its front side with a funnel part 32*a* tapered from an upper side towards a lower side. In the meantime, the lower gear case 32 is fixed to the upper gear case 31 by a plurality of bolts (not shown), for example. The shaft hole 22*a* of the lower housing 22 is formed to penetrate the upper gear case 31 and to communicate with the gear chamber R.

The drive gear 33 and the driven gear 34 are supported to be rotatable in a horizontal direction (around a rotary shaft extending in the upward and downward direction) in the gear case 30 (gear chamber R). The drive gear 33 is arranged on the same shaft center as the output shaft 15*a* of the electric motor 15. The driven gear 34 is arranged in front of the drive gear 33 and is meshed with the drive gear 33.

The gear deceleration device 17 is configured to couple the output shaft 15*a* of the electric motor 15 and a drive shaft 35 extending in the upward and downward direction to each other via the drive gear 33 and driven gear 34. Specifically, the output shaft 15*a* is configured to pass through the shaft hole 22*a* and to spline-couple with a shaft center part of the driven gear 34 at its lower end portion. The drive shaft 35 extends downwards through a shaft hole 32*b* formed at a lower end portion of the funnel part 32*a*. In the meantime, although described in detail later, the drive shaft 35 is configured to transmit an output of the electric motor 15 to a propeller 52 provided in the lower unit 3*b*.

The bracket device 12 includes a swivel unit 40 and a clamp unit 44.

The swivel unit 40 has a substantially cylindrical shape extending in the upward and downward direction and is arranged in front of the electric motor 15 and above the gear deceleration device 17. The swivel unit 40 is bridged between the respective upper mount units 23 and the lower mount unit 24 integrally formed with the motor housing 20. The swivel unit 40 is provided with an upper swivel bracket 41 and a lower swivel bracket 42.

The upper swivel bracket 41 is fixed by bolts (not shown) fastened to the bolt holes 23*a* of the respective upper mount units 23. As shown in FIG. 2B, the lower swivel bracket 42 extends in the right and left direction from the swivel unit 40 and is formed to sandwich the lower mount unit 24 from both right and left sides. The lower swivel bracket 42 is fixed to the lower mount unit 24 via a pair of right and left fitting parts 43 fitted between the front-side flange part 24*a* and the respective rear-side flange parts 24*b*.

The electric motor 15 is supported by a rear side of the swivel unit 40 via the pair of upper and lower mount units 23, 24. Also, the upper unit 3*a* having the electric motor 15 fixed therein is provided to be rotatable in the horizontal direction about the swivel unit 40.

As shown in FIG. 1, the clamp unit 44 is provided at the front of the swivel unit 40. The clamp unit 44 is arranged to straddle an upper part of the transom 4*a* of the hull 4 and is fixed to the transom 4*a*. The clamp unit 44 is coupled to the swivel unit 40 via a tilt pin 45 extending in the right and left direction. That is, the swivel unit 40 is supported by the clamp unit 44 to be rotatable in the upward and downward direction about the tilt pin 45.

A steering handle 47 extending forwards is attached to an upper part of the swivel unit 40 via a handle bracket 46. The steering handle 47 has a substantially cylindrical shape, which is long in the front and rear direction, and is configured to be rotatable in the horizontal direction about the swivel unit 40. In the meantime, the steering handle 47 is connected with the handle bracket 46 via a rotary pin 48. The steering handle 47 is configured to be rotatable rearwards about the rotary pin 48 (refer to an arrow in FIG. 1) and to be foldable.

A tip portion of the steering handle 47 is provided with a throttle grip 47*a*. The throttle grip 47*a* is electrically connected to the control device 16 by a cable (not shown). The control device 16 is configured to control the rotation number of the electric motor 15 in accordance with a rotating amount of the throttle grip 47*a*. In the meantime, an upper surface of the steering handle 47 is provided with a shift switch (not shown) configured to switch forward and reverse rotations of the electric motor 15.

Subsequently, the lower unit 3*b* is described with reference to FIG. 1. The lower unit 3*b* is provided below the upper unit 3*a* and is configured to function as a rudder. The lower unit 3*b* includes a lower unit case 50, a propeller shaft 51 and the propeller 52.

The lower unit case 50 is integrally formed of a synthetic resin, for example, and configures a main outward appearance of the lower unit 3*b*. The lower unit case 50 has a substantial plate shape functioning as a rudder. In the lower unit case 50, the drive shaft 35 extending downwards from the driven gear 34 of the gear deceleration device 17 is pivotally supported.

The drive shaft 35 extends from an upper end portion to a lower part of the lower unit case 50. A lower end portion of the drive shaft 35 is coupled to the propeller shaft 51 via a bevel gear 53. The propeller shaft 51 extends in the front and rear direction and is pivotally supported in the lower unit case 50. A rear end portion of the propeller shaft 51 extends rearwards from a lower-rear surface of the lower unit case 50. The propeller 52 is attached to the rear end portion of the propeller shaft 51.

Here, operations of the outboard motor system 1 are described. In the meantime, it is assumed that the electric outboard motor 3 is attached to the transom 4*a* of the hull 4 by the clamp unit 44.

When a hull operator rotates the throttle grip 47*a*, the control device 16 feeds the power from the power supply unit 2 to the electric motor 15 in accordance with a rotating amount of the throttle grip 47*a*. The rotor (output shaft 15*a*) of the electric motor 15 is rotated by the fed power. The output shaft 15*a* rotates the drive shaft 35 via the gear deceleration device 17 (respective gears 33, 34). The drive shaft 35 rotates the propeller 52 via the bevel gear 53 and propeller shaft 51. Then, the rotation of the propeller 52 propels the hull 4 on the water.

Subsequently, the steering of the electric outboard motor 3 is described. When the hull operator rotates the steering handle 47 in one side of the horizontal direction, the upper unit 3*a* and lower unit 3*b* including the electric motor 15 supported by the swivel unit 40 are rotated in the other side of the horizontal direction. Thereby, the lower unit case 50 serving as a rudder and the propeller 52 are displaced in the other side of the horizontal direction, so that the advancing direction of the hull 4 can be changed (steered).

Subsequently, a tip operation of the electric outboard motor 3 is described. The hull operator tilts up the electric outboard motor 3 when not using the electric outboard motor 3, for example. First, the hull operator folds rearwards the steering handle 47. Then, the hull operator rotates upwards the upper unit 3*a* and lower unit 3*b* about the tilt pin 45, thereby lifting up the propeller 52 and the like from the water. Thereby, the tilt up operation is completed. On the other hand, when using the electric outboard motor 3, the hull operator performs an operation (tilt down operation) reverse to the tilt up operation.

In the illustrative embodiment, the lower unit 3*b* of the electric outboard motor 3 is detachably mounted with respect to the upper unit 3*a*. When separating the lower unit 3*b* from the upper unit 3*a*, the drive shaft 35 is pulled out from the driven gear 34. By separating the lower unit 3*b* from the upper unit 3*a*, the operator can efficiently check, maintain, repair and replace the respective components. In particular, it is possible to easily perform the maintenance (for example, the maintenance of the vicinity of the propeller 52 and, the propeller shaft 51) where it is not required to detach the gear deceleration device 17.

Figure 3:
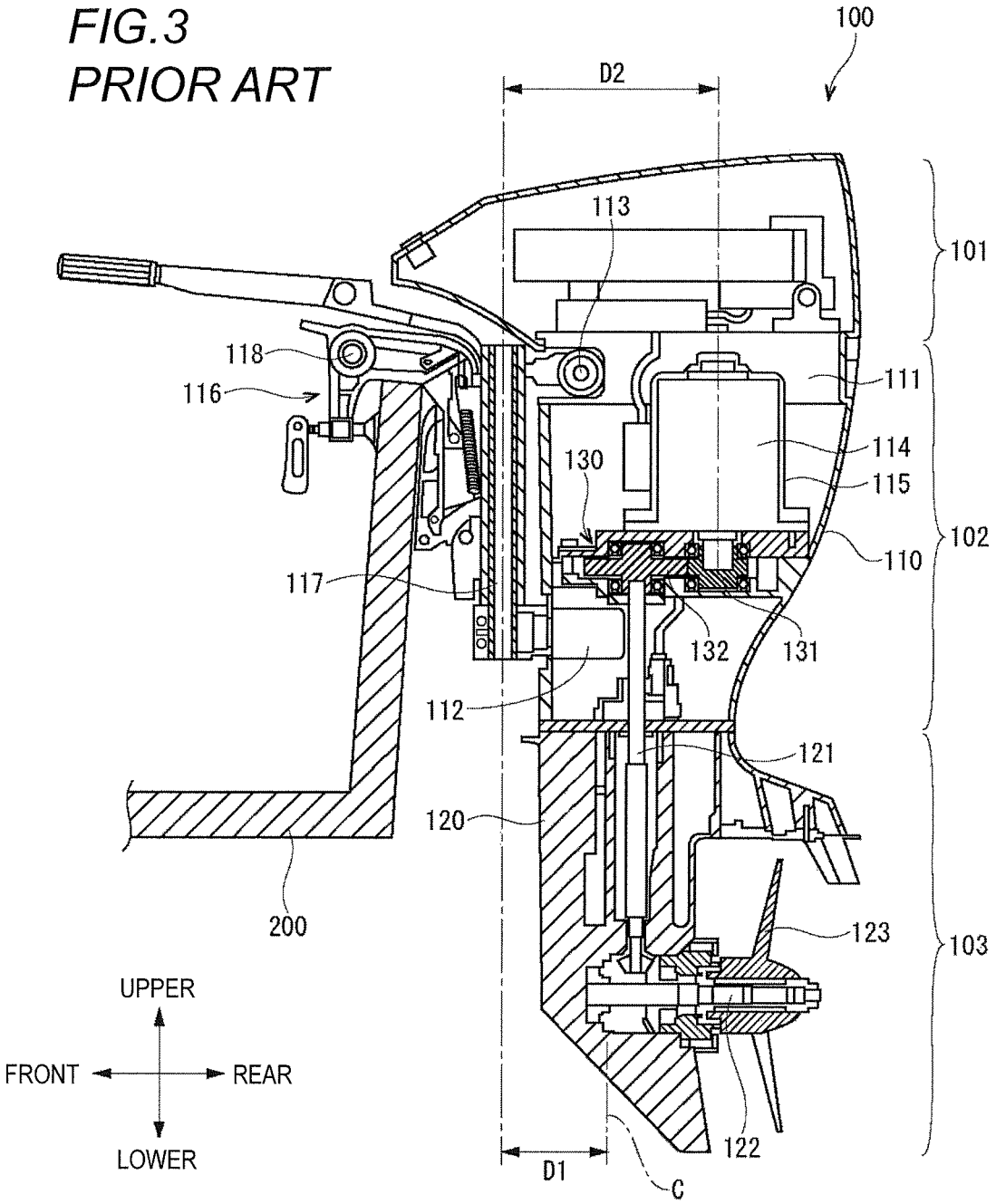
FIG.3 PRIOR ART
FIG. 3 is a longitudinal sectional view illustrating an electric outboard motor of the related art.

As shown in FIG. 1, the drive shaft 35 is coupled to the gear deceleration device 17 in front of the output shaft 15*a* of the electric motor 15. The gear deceleration device 17 is arranged below the swivel unit 40 to overlap with the swivel unit 40 in the front and rear direction. According to the electric outboard motor 3 of the illustrative embodiment, since the gear deceleration device 17 is arranged below the swivel unit 40 so as to overlap with the swivel unit 40, as seen from above, the gear deceleration device 17 does not interfere with the swivel unit 40. Therefore, as compared to the configuration where the gear deceleration device 130 is arranged at the rear of the swivel unit 117 (hereinafter, referred to as the configuration of the related art; refer to FIG. 3), the gear deceleration device 17, the electric motor 15 and the drive shaft 35 are provided at positions close to the swivel unit 40. For this reason, it is possible to make the upper unit 3*a* small.

Since the lower unit 3*b* is also provided at a position close to the swivel unit 40, a center C of the lateral lifting force acting on the lower unit 3*b* (lower unit case 50) serving as a rudder is also close to the swivel unit 40. Therefore, it is possible to reduce an interval D3 (offset amount) between the center C of the lifting force of the rudder and the shaft center of the swivel unit 40, as compared to the interval D1 (refer to FIG. 3) of the configuration of the related art. Thereby, the steering load is reduced to improve the operability of the hull operator. In the meantime, in general, the center C of the lifting force of the rudder is positioned at the slight front of the center of the lower unit case 50 serving as a rudder.

Further, it is possible to bring the electric motor 15, which is a heavy object, close to the swivel unit 40. Therefore, it is possible to reduce an interval D4 between the shaft center of the electric motor 15 and the shaft center of the swivel unit 40, as compared to the interval D2 (refer to FIG. 3) of the configuration of the related art. Thereby, the hull operator can easily perform the tilt operation (tilt up or tilt down operation) of the electric outboard motor 3.

Also, according to the electric outboard motor 3 of the illustrative embodiment, since the upper gear case 31 of the gear case 30 is integrally formed with the motor housing 20, it is possible to reduce the number of components. Also, since the upper gear case 31 and the motor housing 20 are integrally formed and are thus reinforced each other, it is possible to improve the durability.

Further, according to the electric outboard motor 3 of the illustrative embodiment, the pair of upper and lower mount units 23, 24 is integrally formed with the motor housing 20. Therefore, it is possible to omit the motor cover 115 (refer to FIG. 3) provided to cover the electric motor 114 so as to improve the stiffness in the related art. Thereby, it is possible to reduce the number of components and to save the weight. Also, since the upper and lower mount units 23, 24 and the motor housing 20 are integrally formed and are thus reinforced each other, it is possible to improve the stiffness.

In the meantime, the gear deceleration device 17 of the electric outboard motor 3 of the illustrative embodiment is provided in the upper unit 3*a*. However, the present invention is not limited thereto. For example, the gear deceleration device 17 may be provided in (the upper part of) the lower unit 3*b*.

In the meantime, according to the electric outboard motor 3 of the illustrative embodiment, the pair of upper and lower mount units 23, 24 and the motor housing 20 are integrally formed. However, the present invention is not limited thereto. For example, the respective mount units 23, 24 configured as separate members from the motor housing 20 may be fixed to the motor housing 20 by bolts and the like. Also, the number of mount units is arbitrary. That is, one or more mount units may be provided.

The illustrative embodiment relates to an aspect of the electric outboard motor of the present invention, and the technical scope of the present invention is not limited thereto. The constitutional elements of the illustrative embodiment can be appropriately replaced or combined with the constitutional elements of the related art. The present invention defined in the claims is not limited by the descriptions of the illustrative embodiment.

What is claimed is:

1. An electric outboard motor comprising:

an upper unit provided to be rotatable in a horizontal direction about a swivel unit; and a lower unit provided below the upper unit and configured to function as a rudder, wherein the upper unit comprises an electric motor supported by a rear side of the swivel unit via a mount unit, wherein the upper unit or lower unit has a gear deceleration device configured to couple an output shaft of the electric motor and a drive shaft extending in an upward and downward direction to each other, wherein the drive shaft is coupled to the gear deceleration device in front of the output shaft of the electric motor and configured to transmit an output of the electric motor to a propeller provided in the lower unit, wherein the gear deceleration device is arranged below the swivel unit so as to overlap with the swivel unit in a front and rear direction, wherein the gear deceleration device is provided in the upper unit, and wherein the lower unit is detachably provided with respect to the upper unit.

2. The electric outboard motor according to claim 1, wherein the gear deceleration device is provided in the upper unit and comprises a gear case having a plurality of gears provided therein, wherein the gear case has an upper gear case provided at an upper side and a lower gear case provided at a lower side, and wherein the upper gear case is integrally formed with a motor housing having a rotor and a stator of the electric motor provided therein.

3. The electric outboard motor according to claim 1, wherein the mount unit is integrally formed with a motor housing having a rotor and a stator of the electric motor provided therein.

4. The electric outboard motor according to claim 2, wherein the mount unit is integrally formed with a motor housing having a rotor and a stator of the electric motor provided therein.

5. An electric outboard motor comprising:

an upper unit provided to be rotatable in a horizontal direction about a swivel unit; and a lower unit provided below the upper unit and configured to function as a rudder, wherein the upper unit comprises an electric motor supported by a rear side of the swivel unit via a mount unit, wherein the upper unit or lower unit has a gear deceleration device configured to couple an output shaft of the electric motor and a drive shaft extending in an upward and downward direction to each other, wherein the drive shaft is coupled to the gear deceleration device in front of the output shaft of the electric motor and configured to transmit an output of the electric motor to a propeller provided in the lower unit, wherein the gear deceleration device is arranged below the swivel unit so as to overlap with the swivel unit in a front and rear direction, wherein the gear deceleration device is provided in the upper unit and comprises a gear case having a plurality of gears provided therein, wherein the gear case has an upper gear case provided at an upper side and a lower gear case provided at a lower side, and wherein the upper gear case is integrally formed with a motor housing having a rotor and a stator of the electric motor provided therein.

6. The electric outboard motor according to claim 5, wherein the mount unit is integrally formed with a motor housing having a rotor and a stator of the electric motor provided therein.

* * * * *